United States Patent [19]

Schuette

[11] 4,266,901

[45] May 12, 1981

[54] STORAGE BIN HAVING DRIVEN AGITATOR

[75] Inventor: Henry W. Schuette, Tigard, Oreg.

[73] Assignee: Wellons, Inc., Sherwood, Oreg.

[21] Appl. No.: 957,455

[22] Filed: Nov. 3, 1978

[51] Int. Cl.[3] ..... B65G 65/48; F16H 27/02

[52] U.S. Cl. ..... 414/305; 74/166

[58] Field of Search ..... 414/305, 306, 310–312; 222/404; 198/812, 813, 816, 859; 24/32; 74/242.8, 166

[56] References Cited

U.S. PATENT DOCUMENTS

| | | | |
|---|---|---|---|
| 624,760 | 5/1899 | Herdeyn | 24/32 |
| 2,529,777 | 11/1950 | McInnis | 198/859 |
| 2,755,942 | 7/1956 | Broberg | 414/306 |
| 3,339,759 | 9/1967 | Wellons | 414/305 |
| 3,817,409 | 6/1974 | Weaver | 414/311 X |

FOREIGN PATENT DOCUMENTS

| | | | |
|---|---|---|---|
| 1927671 | 4/1971 | Fed. Rep. of Germany | 414/306 |

*Primary Examiner*—Robert G. Sheridan

*Attorney, Agent, or Firm*—Klarquist, Sparkman, Campbell, Leigh, Whinston & Dellett

[57] ABSTRACT

A particle feeding hopper having an elongate agitator positively driven around the hopper's inner surface by a reciprocating ratchet mechanism. The mechanism drivingly engages a circular chain connected to the agitator.

4 Claims, 10 Drawing Figures

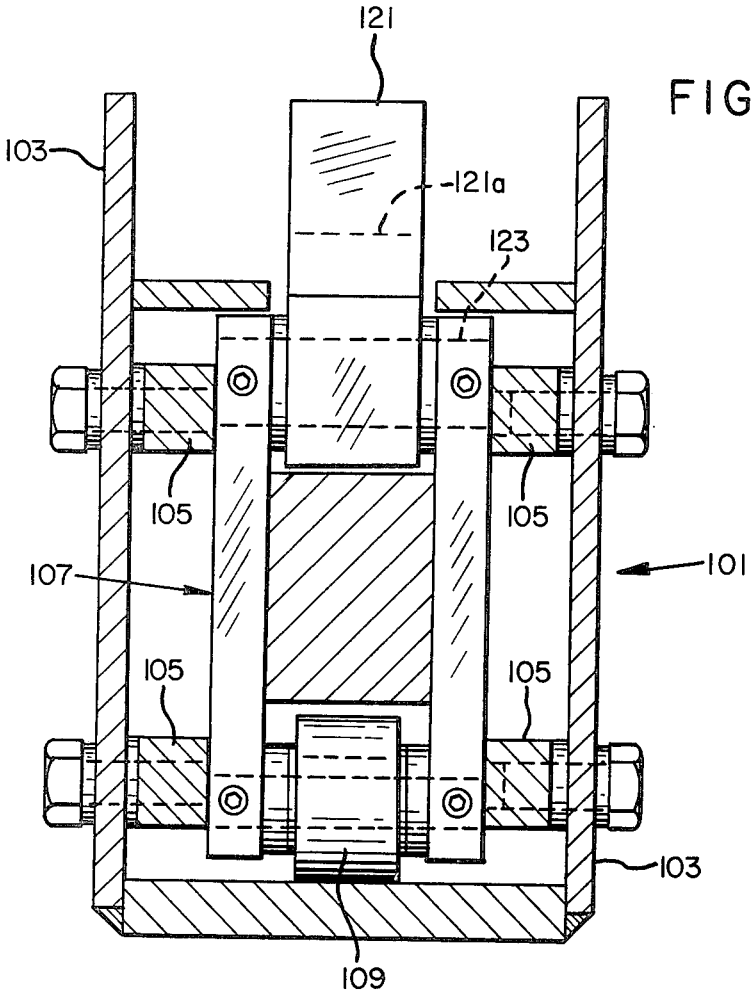
FIG. 6
FIG. 7
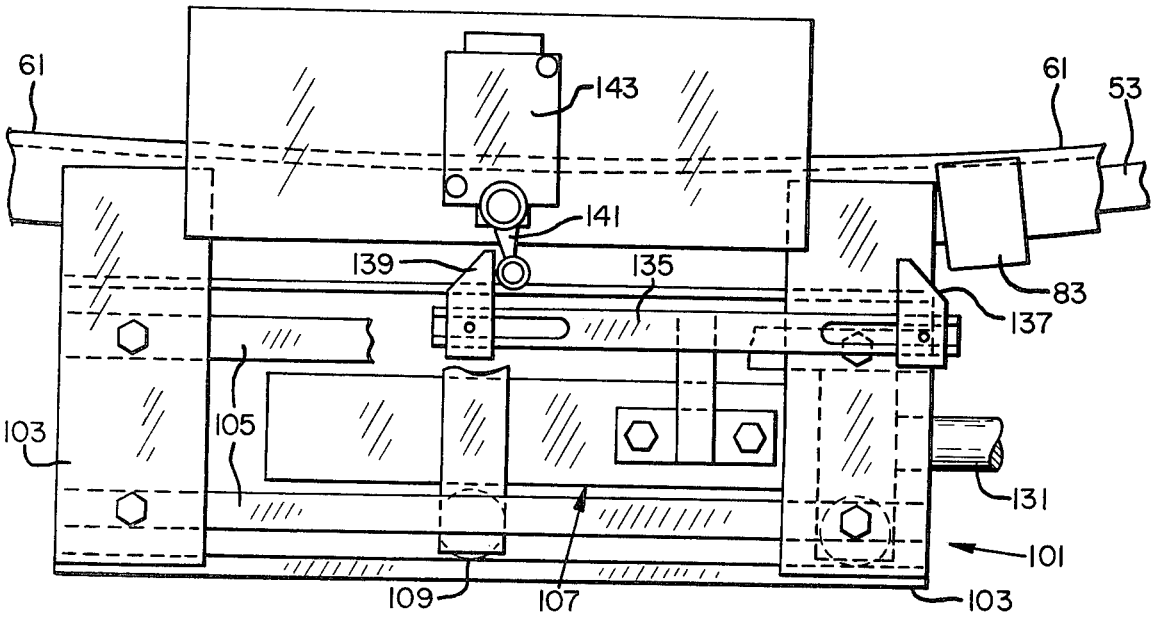

STORAGE BIN HAVING DRIVEN AGITATOR

BACKGROUND OF THE INVENTION

In the prior U.S. Pat. No. 3,339,759, the hopper agitator is driven around the upper edge of the hopper by frictional engagement of a drive wheel with a track on such edge. This has been satisfactory for many installations but not for severe operating conditions, such as dense, stringy fuel, particularly when frozen or partially frozen.

SUMMARY OF THE INVENTION

The present invention overcomes the above difficulties by providing a positive drive for the agitator, including a reciprocating ratchet mechanism driving a circular chain around a raceway, the chain carrying the agitator with it.

A main object of the present invention is to provide an improved drive for a hopper agitator, and particularly a positive rather than a frictional drive.

The subject matter which I regard as my invention is particularly pointed out and distinctly claimed in the concluding portion of this specification. The invention, however, both as to organization and method of operation, together with further advantages and objects thereof, may be best understood by reference to the following description, taken in connection with the following drawings, wherein like reference characters refer to like elements.

FIG. 6 is a cross sectional view through FIG. 5;

FIG. 7 is a view of the limit switch arrangement for the chain drive mechanism;

DESCRIPTION OF A PREFERRED EMBODIMENT

Figure 1:
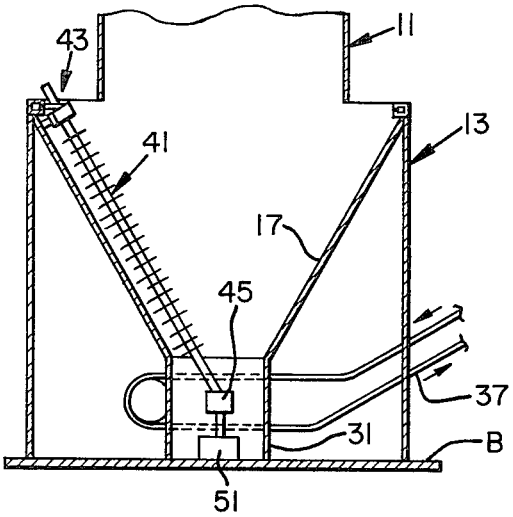
FIG. 1 is a schematic vertical cross sectional view of a silo embodying the concepts of the present invention.

Referring to FIG. 1, the silo shown includes an upright cylindrical bin 11, supported at its lower end by a circular multiple post structure including plural posts 13. A frustoconical hopper 17 is supported coaxially beneath the bin 11 on the post structure in a manner to be presently alluded to.

Particle fuel material in the hopper gravity feeds downwardly into a discharge box 31, which has suitable auger devices (not shown) to feed material onto the lower reach of a belt conveyor 37. The above structure is common to that in U.S. Pat. No. 3,339,759 to Charles L. Wellons.

Arranged within the hopper 17 is an agitator feeder 41 having a wheeled truck 43 at its upper end, connected at its lower end by a universal joint 45 to a drive motor 51. The entire structure rests on a base B.

Figure 2:
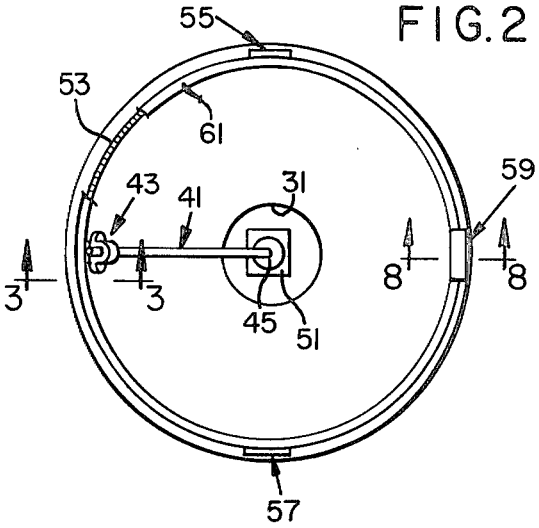
FIG. 2 is a schematic plan view of the upper portion of the hopper, showing the relationship of certain important components.

FIG. 2 shows the agitator 41 and the truck 43, the latter being connected to a drive chain 53 which extends completely around the upper end of the hopper. The chain may be of several types but an offset side bar mill chain will do. The chain is driven by a pair of chain drives in the form of cylinder actuated ratchet mechanisms 55 and 57. FIG. 2 also shows a chain take-up device 59.

Figure 3:
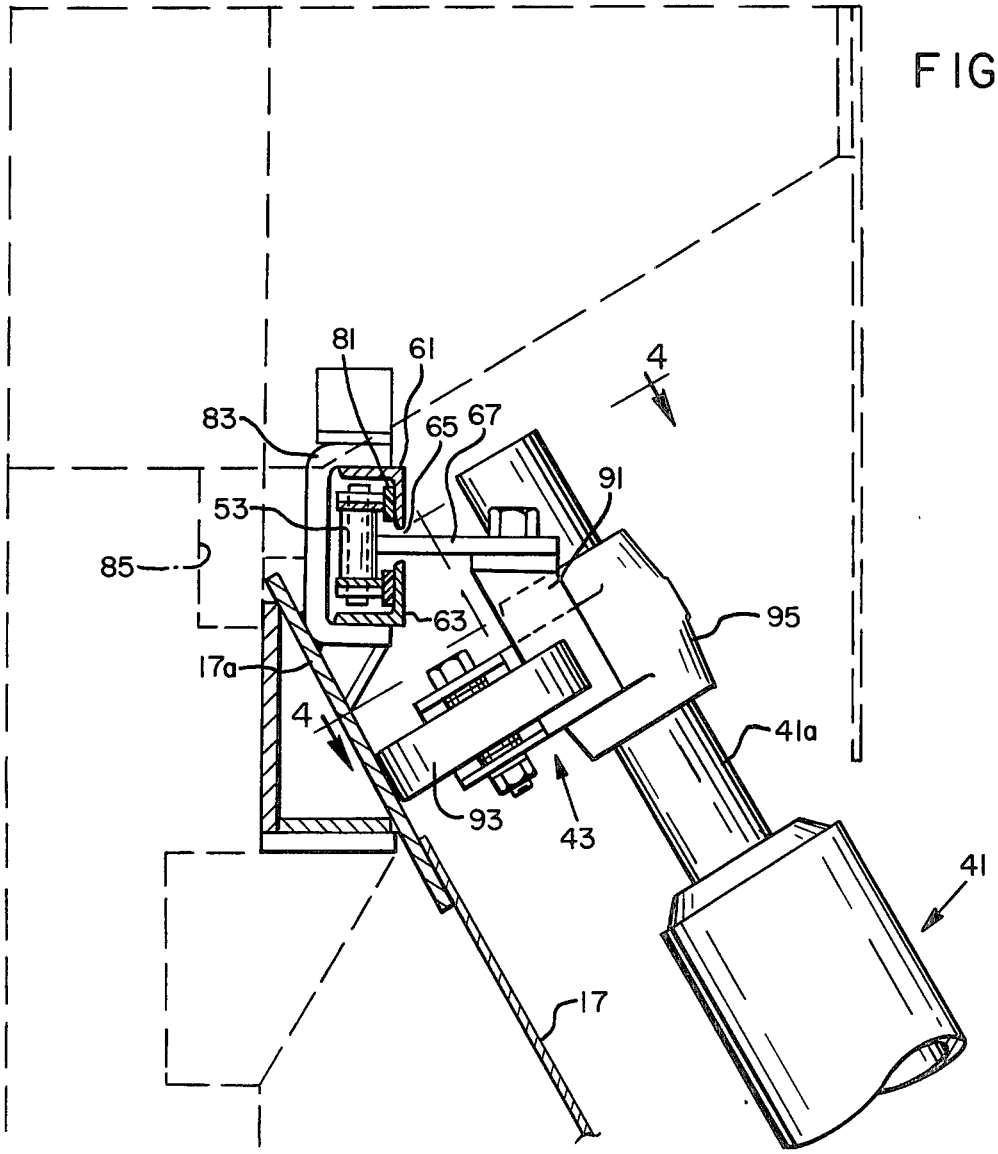
FIG. 3 is a fragmentary enlarged sectional view taken along line 3—3 of FIG. 2, showing the manner of mounting the upper end of the agitator shaft.

FIG. 3 shows the chain 53 riding on a raceway made up of two angle iron ring-like raceway members 61 and 63 which extend completely around the upper mouth of the conical hopper 17. The two members are separated from one another to provide a continuous and uninterrupted slot 65 to accommodate a pair of brackets 67 which are secured at their left hand ends, as the parts are shown in FIG. 3, to links of the chain 53. The chain rides on a pair of liner strips 81 which are of the hard, generally frictionless plastic material, such as high density polyurethane.

The angle iron members 61 and 63 are held in the desired spatial relationship by a plurality of C-shaped mounting elements 83, one of which is shown in FIG. 3. The elements 83 are secured to the upper portion of the conical hopper by suitable attachment clips or pieces 85.

Figure 4:
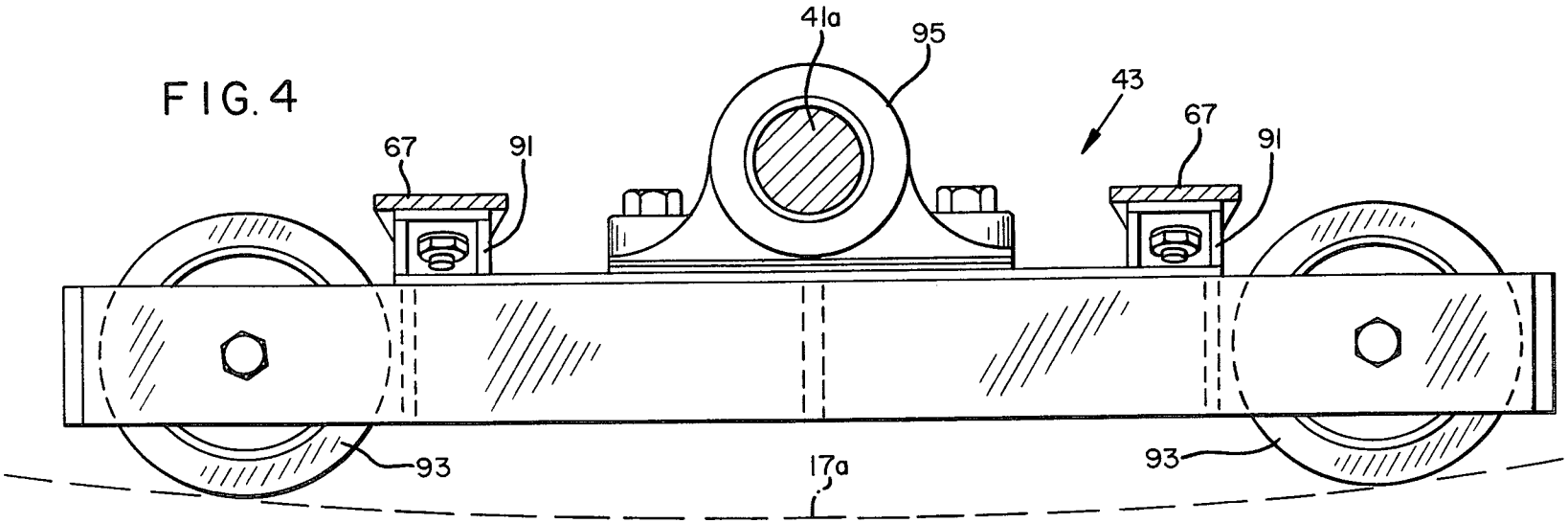
FIG. 4 is a sectional view taken along line 4—4 of FIG. 3.

FIGS. 3 and 4 show that the brackets 67 are bolted at their left hand ends to the frame 91 of the wheeled truck, generally indicated by the reference numeral 43. FIG. 4 shows that the truck has a spaced pair of wheels 93 riding upon an upper heavy extension 17*a* of the hopper 17. Between the wheels, the frame 91 carries a bearing 95 which journals an upper shaft portion 41*a* of the agitator 41, the journal permitting the upper shaft portion to slide axially relative to the bearing as demanded by the operating conditions and the proportions and dimensions of the parts of the overall structure.

Figure 5:
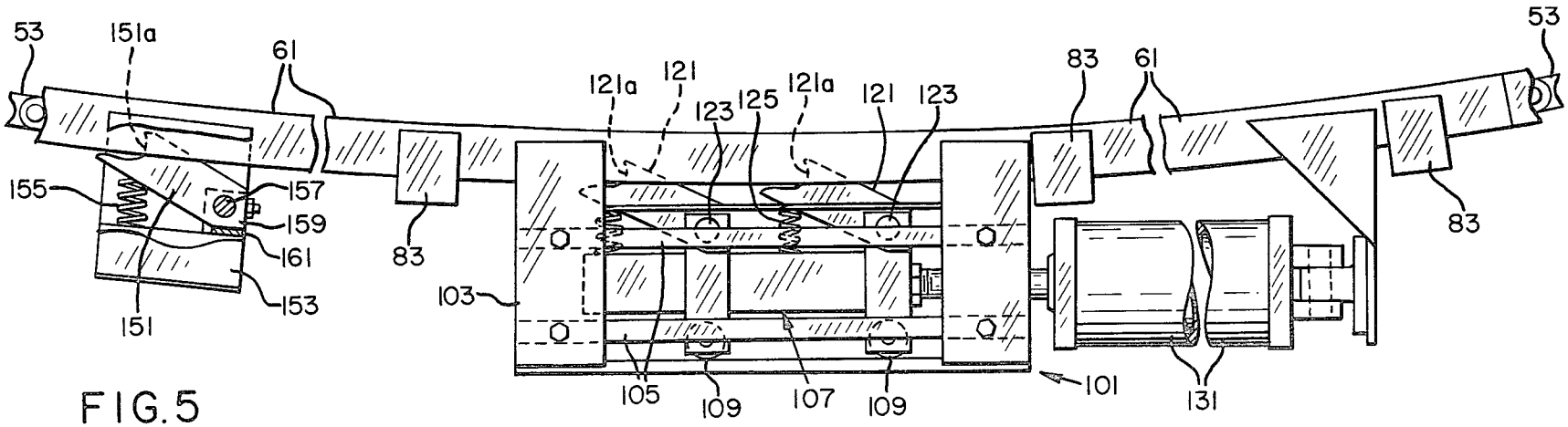
FIG. 5 is a fragmentary plan view of a chain drive mechanism.
Figure 8:
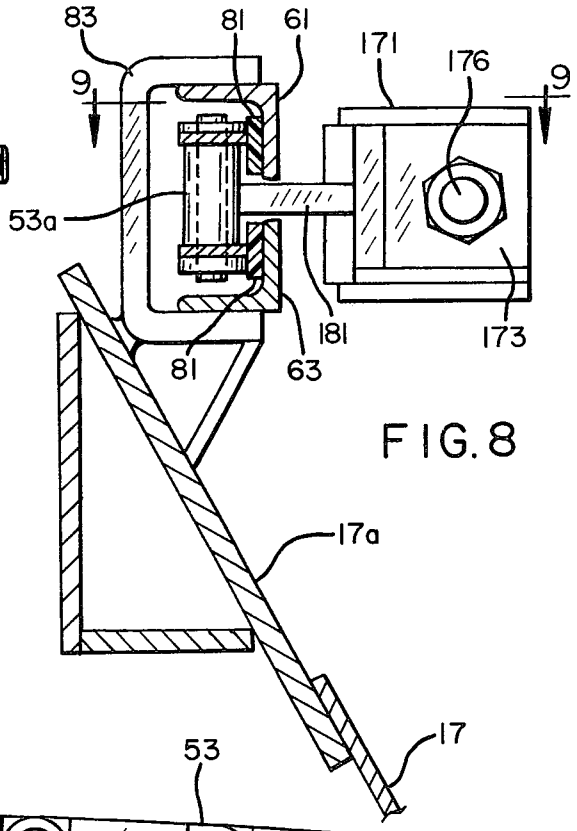
FIG. 8 is a vertical section taken along line 8—8 of FIG. 2 showing the chain take-up device.

FIGS. 5–7 show one of the two identical chain drives, the drive comprising an open framework cage 101 (FIG. 6) which includes a pair of end bracket members 103, which members embrace the chain raceway 61–63 and are fixedly secured thereto. The cage is provided with two pairs of races or guide strips 105 (FIG. 6) which slidably receive a ratchet truck generally indicated by the reference numeral 107. The ratchet truck has a pair of rollers 109 riding on the cage 101. The ratchet truck carries a pair of ratchets 121 (FIG. 5) which are mounted by pivot pins or shafts 123 to the ratchet truck 107. A compression spring 125 for each ratchet constantly urges the ratchet inwardly into contact with the chain 53.

The ratchet truck is reciprocated by a double acting cylinder 131 which has its piston rod end connected to the ratchet truck 107 and its opposite end pivotally mounted on a bracket 133 fixed to the chain raceway.

FIG. 7 shows that the ratchet truck carries a limit switch trip arm 135 having a pair of adjustably positioned trips 137 and 139 to alternately engage and trip the trip finger 141 of a limit switch 143.

The cylinder will drive the ratchet truck in one direction until one of the trips engages the finger 141 to actuate the switch to effect a reversal of the supply of fluid to the cylinder to cause the cylinder to reverse the direction in which it drives the ratchet truck, the truck thus moving in the reverse direction until the other trip engages the finger 141 of the limit switch 143, whereupon the direction of movement of the ratchet truck is again reversed. Thus, the ratchet truck is reciprocated back and forth so that when the truck moves toward the left as the parts are shown in FIG. 5, the notched ends 121*a* of the ratchets will catch on bars of the chain 53 to advance the chain to the left. When the cylinder reverses direction, the springs 125 will permit the ratchets to move in the opposite direction sliding over the bars of the chain, leaving the chain in the position to which it has been moved.

FIG. 5 shows that there is a holding pawl 151 carried by a bracket 153, mounted on the chain raceway, the pawl being urged by a compression spring 155 into engagement with the chain 153. The pawl 151 is mounted for pivotal movement about a pin or shaft 157, but it is in a "bodily stationary" position. Its function is to hold the chain against backing up during the time that the ratchet truck is retreating. It will be understood that the forward movement of the chain presses the agitator 41 forceably against the particled material in the conical hopper. This material is somewhat resilient, thus tending to move the agitator rearwardly, were it not for the holding pawl 151.

Each of the ratchets and the pawl shown in FIG. 5 is prevented from engaging the liner 81 (FIG. 3) by having tail portions labeled 159 for pawl 151 engaging a shim 161 secured to the bracket 153. By an exchange of shims, the right spatial position of the notched end 151*a* of the pawl relative to the chain and liners can be attained.

Figure 10:
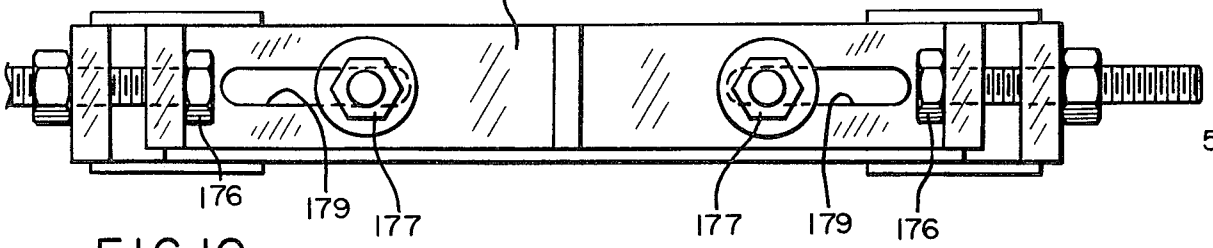
FIG. 10 is a view taken in the direction of the arrows of FIG. 9.
Figure 9:
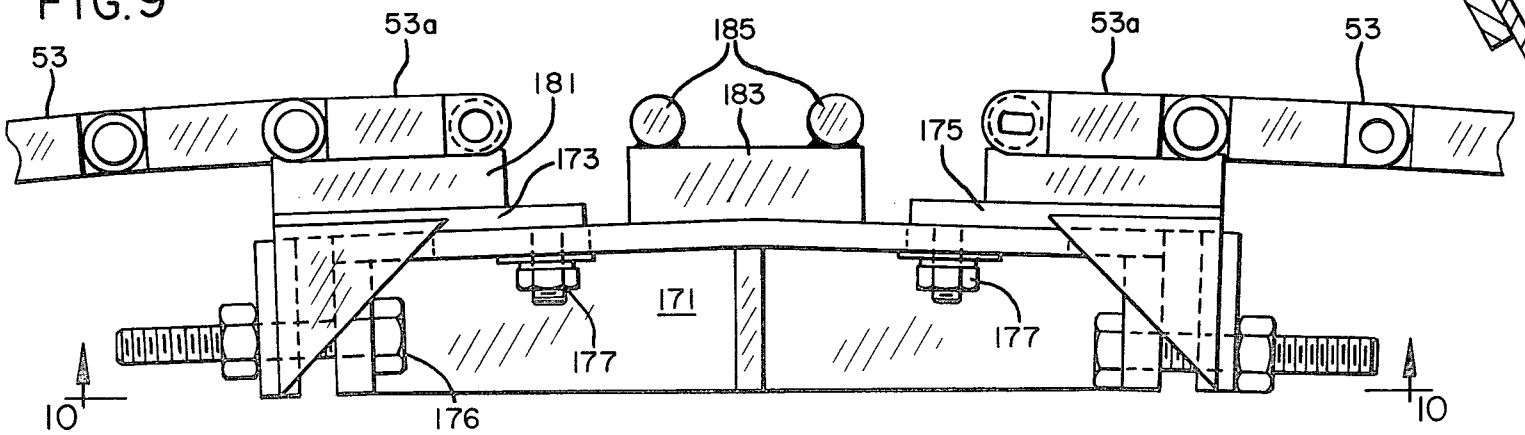
FIG. 9 is a plan view taken in the direction of the arrows 9—9 of FIG. 8.

The chain take-up device 59 (FIGS. 2 and 8–10) assures that the chain 53 is maintained in a taut condition in its raceway. Slidably fitting on the ends of an elongate body member 171 (FIGS. 9 and 10) are a pair of take-up shoes 173 and 175 each of which is mounted for movement to various positions of adjustment relative to the body member by a longitudinal take-up screw 176 and a holding screw 177, the latter fitting in a longitudinal slot 179 (FIG. 10) formed in the body 171.

The take-up device includes a pair of end mounting flanges 181, which are secured to the body member 171 in midpositions widthwise of said body member. These flanges are of a size to fit through the slot 65 (FIG. 8) of the chain raceway. Permanently attached to the outer edge of each flange is a chain link 53*a* of the same type as the links making up the chain 53, and thus links 53*a* simply constitute the end links of the chain.

There is a third flange 183 disposed between flanges 181 and fitting in the slot 65 and carrying a pair of false chain bars 185. These are to provide simulated chain links disposed between links 53*a* so that the drive to the chain is not interrupted at the take-up device 59.

What is claimed is:

1. In a structure of the class described:

a hopper including an inner frustoconical surface having a vertical axis, an agitator within said hopper disposed parallel to said frustoconical surface and having a lower end and an upper end, means for driving the agitator in a circular path next to said frustoconical surface, said means including a pair of spaced circular raceway members facing away from said vertical axis, an elongate circular drive element riding on both of said raceways and spanning the distance therebetween, wheel means supporting the upper end of said agitator and riding on said frustoconical surface, connector means connecting said wheel means to said drive element whereby said raceway members and wheel means combine to hold the upper end of said agitator at a substantially fixed distance from said frustoconical surface, and reciprocating means engaging said elongate drive element for advancing the latter around said raceway and thus causing desired movement of said agitator.

2. The structure of claim 1 wherein said drive element comprises a chain, said reciprocating means including ratchet means for engaging said chain, and double acting cylinder means for reciprocating said ratchet means.

3. The structure of claim 2 in which said chain has end portions connected together by a take-up mechanism, said mechanism including a body member disposed interiorly of said raceway, and connector means connecting said body to said chain through said raceway slot.

4. In a structure of the class described:

an agitator, means for driving the agitator in a circular path around a feeding zone, said means including a circular raceway, an elongate drive chain in said raceway connected to said agitator, and reciprocating means engaging said elongate drive chain for advancing the latter around said raceway and thus causing desired movement of said agitator, a take up mechanism connecting end portions of said chain, said take up mechanism providing simulated chain elements engageable by said reciprocating means.

* * * * *